US005681231A

United States Patent [19]

Reeves

[11] Patent Number: 5,681,231

[45] Date of Patent: Oct. 28, 1997

[54] COLLAPSIBLE GAME GOAL

[76] Inventor: Francis J. Reeves, 357 Council Oak Dr., Severn, Md. 21144

[21] Appl. No.: 288,309

[22] Filed: Aug. 10, 1994

[51] Int. Cl.[6] ..... A63B 63/00

[52] U.S. Cl. ..... 473/471; 473/421

[58] Field of Search ..... 273/127 B, 30, 273/401, 26 A, 29 A; 285/5

[56] References Cited

U.S. PATENT DOCUMENTS

| | | | |
|---|---|---|---|
| 1,567,446 | 12/1925 | McClure . | |
| 2,077,343 | 4/1937 | Oakes | 273/127 B |
| 2,111,448 | 3/1938 | Hoffman | 189/84 |
| 2,582,864 | 1/1952 | Gittings et al. | 155/140 |
| 2,859,038 | 11/1958 | Parikos | 273/30 |
| 3,979,120 | 9/1976 | Dietrich | 273/127 |
| 4,127,272 | 11/1978 | Pennell | 273/102 |
| 4,264,070 | 4/1981 | Torres | 273/29 |
| 4,339,132 | 7/1982 | Stevens | 273/127 B |
| 4,420,158 | 12/1983 | Klock et al. | 273/400 |
| 4,702,478 | 10/1987 | Kruse | 273/127 B |
| 4,921,257 | 5/1990 | Heller | 273/401 |
| 4,960,284 | 10/1990 | Stude | 273/395 |
| 5,048,844 | 9/1991 | Haseltine | 273/400 |
| 5,080,375 | 1/1992 | Moosavi | 273/127 B |
| 5,116,056 | 5/1992 | Schmutte | 273/181 |
| 5,186,469 | 2/1993 | Terris | 273/400 |
| 5,251,938 | 10/1993 | Ericksen | 285/5 |
| 5,413,340 | 5/1995 | Potvin | 273/127 B |

*Primary Examiner*—Theatrice Brown
*Attorney, Agent, or Firm*—Foley & Lardner

[57] ABSTRACT

A collapsible game goal, such as for lacrosse, has joints at the intersections of the uprights with the crossbar and the lower frame members. The net is configured such that a portion of the net is installed inside the frame members. The goal can therefore be easily collapsed, such as for transport to a different location. The goal can then be easily put in place, by unfolding the frame members.

12 Claims, 14 Drawing Sheets

COLLAPSIBLE GAME GOAL

BACKGROUND OF THE INVENTION

Many games, such as soccer, hockey and lacrosse, require a goal incorporating a net such that a participant scores by causing a ball, puck or other projectile to enter the goal. Goals for these games are large and not easily transportable. When such goals are put in a specific location, they tend to remain in that location on a substantially permanent basis. It is therefore inconvenient for one to use the same goal to support games occurring at different times and at different locations.

The lack of mobility of these goals is a function of their size and the fact that they cannot be collapsed, folded or disassembled.

SUMMARY OF THE INVENTION

It is therefore an object of this invention to provide a goal which is easily collapsible. It is also an object of this invention to provide a goal where a portion of the net is incorporated into the frame such that the net remains attached to the frame when the goal is collapsed.

In one embodiment of a goal according to the invention, for example, a goal used for the game of lacrosse, the goal includes a net, a crossbar, at least two uprights, and joints provided between the uprights and the crossbar. The uprights and the crossbar also have net receiving means which receive and hold a portion of the net such that the net is attached to the crossbar and the uprights. This embodiment of the invention may also include means for attaching the bottom portion of the net to the ground.

Alternatively, in another embodiment of a goal according to the invention, the frame further includes lower frame members which lie upon the ground. Like the uprights and the crossbar, these lower frame members also contain net receiving means. These lower frame members, in an embodiment of the invention designed for lacrosse, are connected to each other by a joint forming a point with the lower frame members.

In yet another embodiment according to the invention, the uprights and crossbar (and lower frame members, if used) contain grooves within which the hem of the net is positioned such that these grooves provide the net receiving means.

In still another embodiment of a goal according the invention, the net does not have a hem, but is configured such that each outer strand of the net ends with a terminating point which can be inserted into a corresponding hole in the crossbar, uprights, or lower frame members, which forms the net receiving means.

In another embodiment of a goal according to the invention the hem of the net is-attached to the uprights by a plurality of U-shaped terminating points. In still another embodiment of the invention, joints, for example, where the uprights intersect with the crossbar and/or the lower frame members include an elbow having a gapped arm and an ungapped arm. The ungapped arm is fixed to one of the two intersecting members. The other of the intersecting members is proximate to the gapped arm, such that this intersecting member can be placed in a fixed position inside the gapped arm or a collapsed position substantially outside the gapped arm. The two frame members are connected by a flexible material, such as a piece of rubber hose. According to the invention, this embodiment may also include a cap which engages the gapped arm to provide added support when the joint is in the fixed position. The cap may also include a tooth which is fit into a corresponding notch in the gapped arm when the joint is in the fixed position. This embodiment may also employ a clamp connecting the ungapped arm to its frame member.

In yet another embodiment of a goal according to the invention, one or more joints can also be provided in the crossbar. Similarly, joints can be provided in any of the substantially straight members of the frame, such as within an upright or a lower frame member.

Another embodiment of a goal according to the invention provides a method of connecting two frame members of a collapsible game goal by connecting a first frame member to an ungapped arm of an elbow and also connecting the first frame member to one end of a flexible material, such as a rubber hose. The other end of the flexible material is connected to the second frame member, such that the second frame member can be placed inside a gapped arm of the elbow. According to this method, a cap can then be engaged with the gapped arm of the elbow.

Yet another embodiment of a goal according to the invention provides a method of installing a net inside the frame of the goal by cutting a groove into the frame members and placing the hem of the net inside of the groove.

A still further embodiment according to the invention provides for installing a net inside a goal by inserting a plurality of terminating points of the net into a corresponding plurality of holes contained in the frame members.

Yet another embodiment according to the invention provides a method of collapsing a game goal by disengaging a cap from a gapped arm of an elbow of at least one joint and pushing a frame member through a gap in the gapped arm.

BRIEF DESCRIPTION OF THE DRAWINGS

These and other embodiments of the invention will be apparent to one skilled in the art upon review of the drawings wherein.

DETAILED DESCRIPTION

Figure 1:
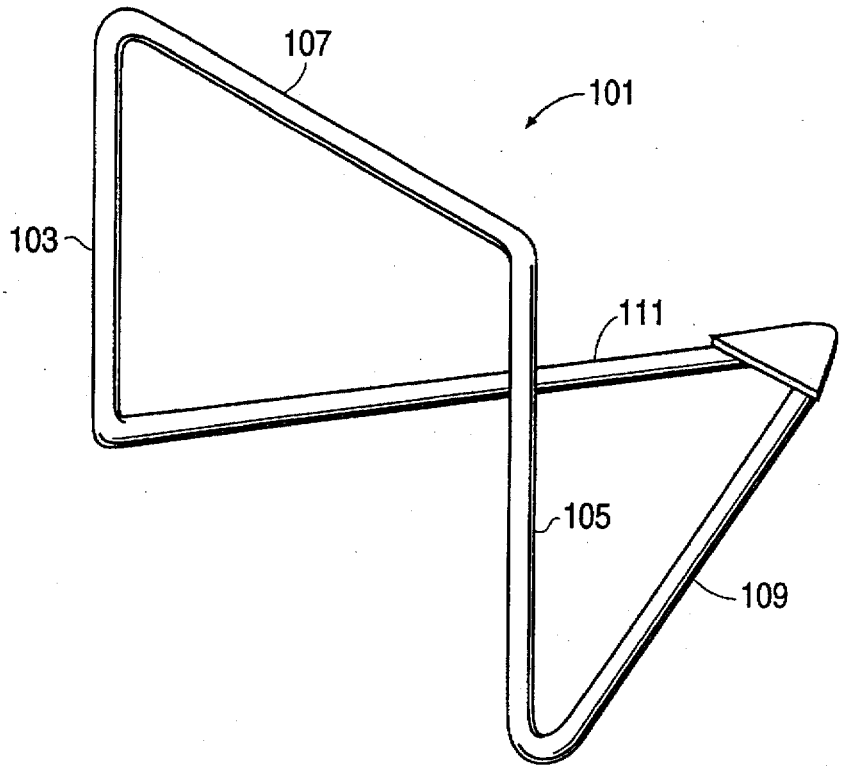
FIG. 1 is a view of the frame of a traditional lacrosse goal.

FIG. 1 displays a conventional lacrosse goal frame 101. Frame 101 consists of left upright 103, right upright 105, crossbar 107, and lower frame members 109 and 111. The members of frame 101 are permanently attached to each other. For example, if frame 101 is constructed from metal pipe, the frame members can either be constructed from the same piece of pipe, or be separate pieces of pipe which are welded to each other or separate pieces of pipe which are threaded and screwed together.

Figure 2:
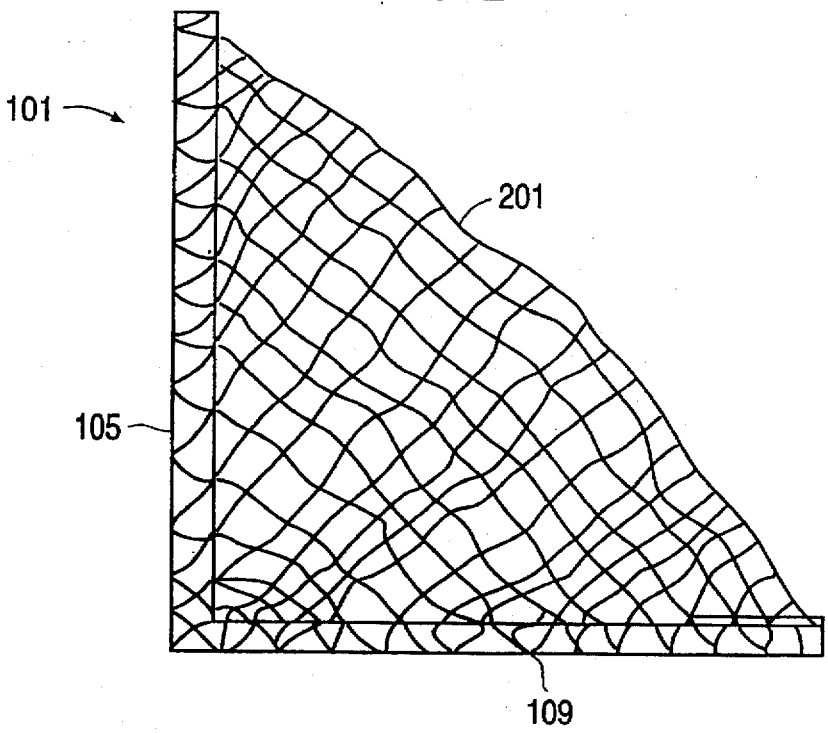
FIG. 2 is a side view of the frame of FIG. 1 with a net attached in a conventional manner.

FIG. 2 shows a side view of frame 101 with net 201 attached. Net 201 is strung around frame 101. The process of stringing a net to a lacrosse goal frame is very time consuming, requiring up to two man hours. Alternatively, conventional nets can be attached to a frame by plastic "ties" such as those conventionally used for harnessing wires or cables.

Figure 3:
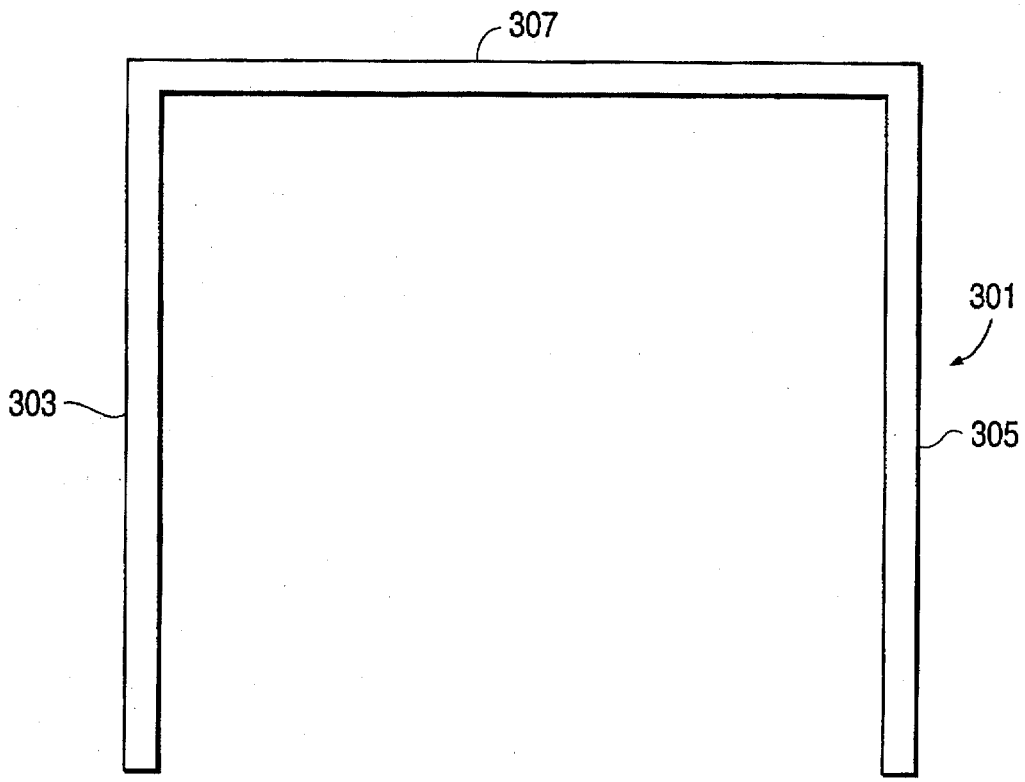
FIG. 3 is a view of an alternate embodiment of a conventional lacrosse goal.

FIG. 3 shows an alternative configuration of a lacrosse goal. Here, frame 301 consists of left upright 303, right upright 305 and crossbar 307. Thus, frame 301 differs from frame 101 in that frame 301 does not have lower frame members analogous to frame members 109 and 111 shown in FIG. 1.

Figure 4:
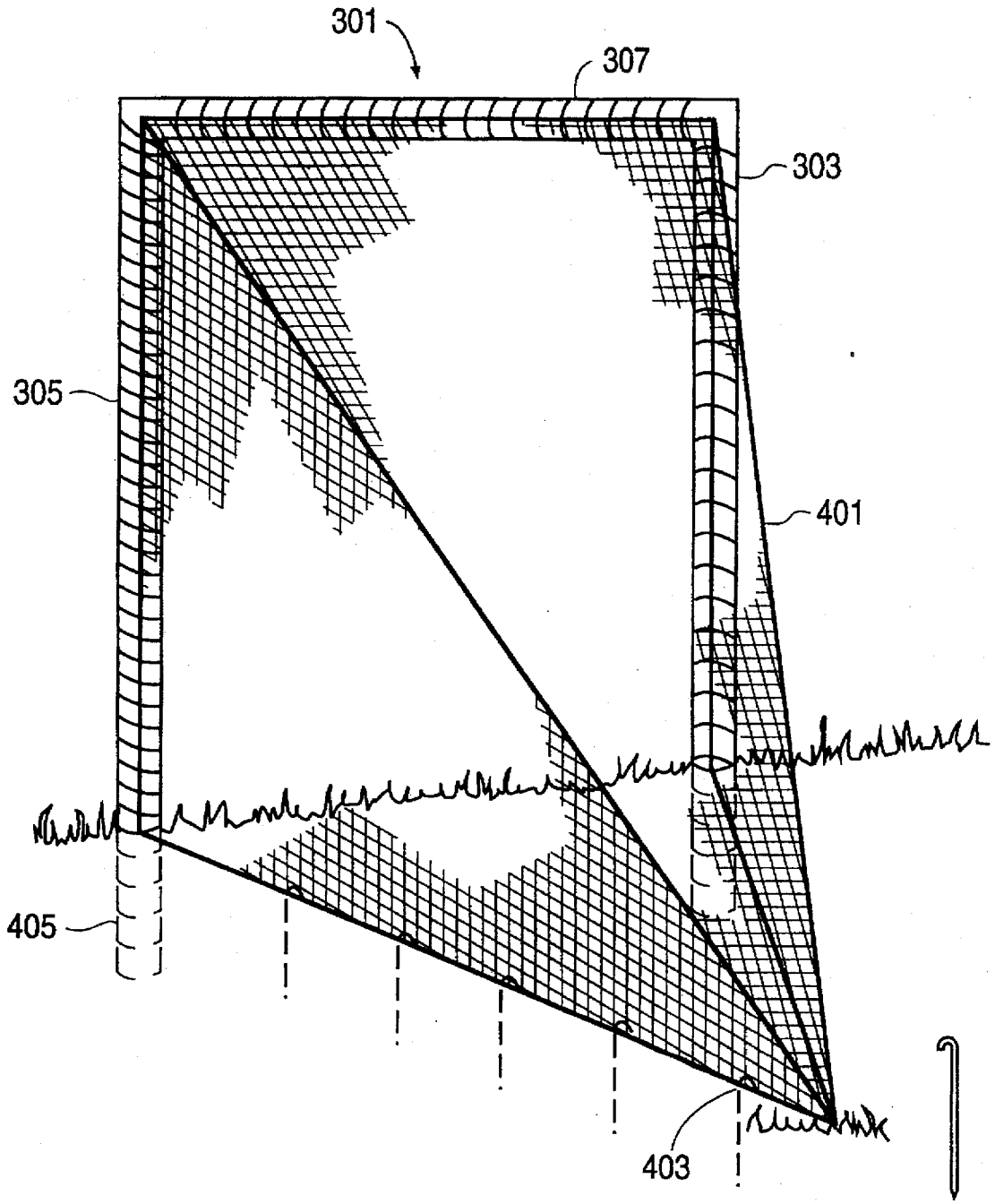
FIG. 4 provides a rear view of the goal of FIG. 3 with a net installed in the conventional manner.

FIG. 4 displays a rear view of frame 301 with net 401 attached. U-shaped spikes 403 connect net 401 to the ground. To hold the frame in place, uprights 303 and 305, which are typically made of hollow piping, could be fit over spikes 405 which are properly positioned in the ground. It can thus be seen that the configuration using frame 301 is not suitable for use on astro turf or other hard surfaces. Instead, frame 301 and net 401, as shown in FIG. 4, can only be used when the game is played on natural turf. As with the goal of FIG. 2, the net is strung around the frame in a time consuming manner. Once this frame is put in place, it is very inconvenient to move it to another location.

It can therefore be seen that although the goals of FIGS. 2 and 4 are theoretically transportable, their transport to alternative locations is problematical. Further, if the net used in either of these goals breaks, as may result from a mishap during transport or from dry rot due to extended exposure to outside elements, replacement of the net is very inconvenient and time consuming.

The goal according to the invention provides a new configuration of goal which can be easily collapsed for transport. Thus, the net can be easily transported and can be brought inside when not in use. Moreover, in at least one embodiment of the goal according to the invention, the net can be replaced in a greatly reduced amount of time when compared to net replacement time of a conventional goal. This goal according to the invention incorporates collapsible joints into the frame, at, for example, the points of intersection of the frame members. These joints allow the goal to be easily collapsed and easily emplaced.

Figure 5:
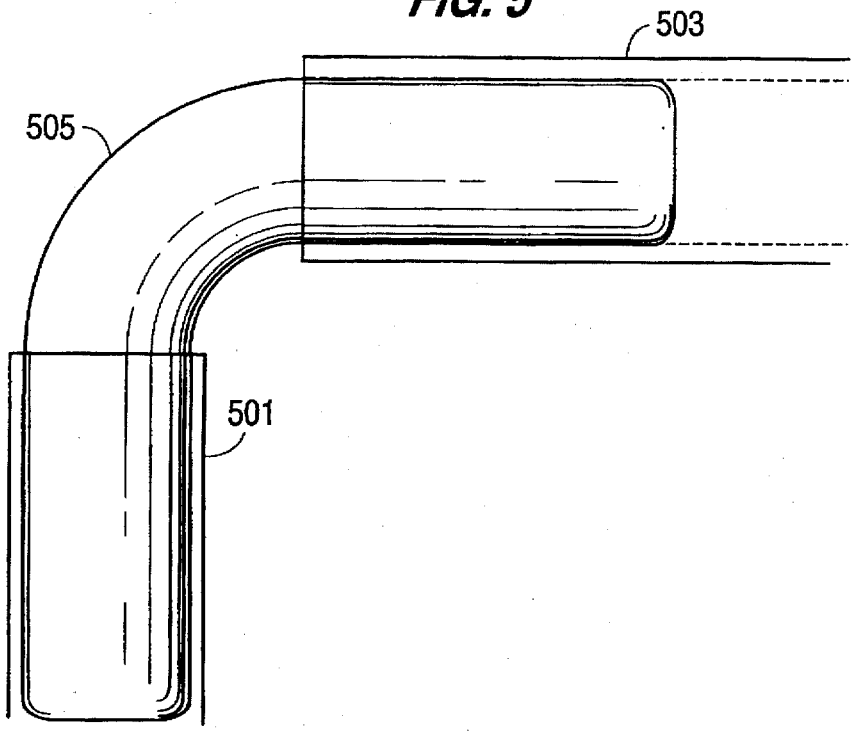
FIG. 5 shows the connection of two frame members with a flexible material such as a rubber hose forming a part of one embodiment according to the invention.

FIG. 5 shows two frame members 501 and 503 which intersect in a goal according to the invention. These frame members can be viewed as any two intersecting frame members, but for purposes of this discussion frame member 501 will be viewed as the left upright and frame member 503 will be viewed as the crossbar. In a conventional goal, as discussed above, these two members would be permanently attached. For example, if the frame is metal, they would either be part of the same piece of pipe, or would be welded or screwed together. In a conventional goal there is, thus, no freedom of movement between the two frame members.

Frame members in a goal according to the invention 501 and 503 can be hollow pipes composed of any type of material. For example, they can be constructed from aluminum, steel, copper or any other metal, or can be composed of synthetic materials, such as polyvinyl chloride. For example, frame members 501 and 503 can be constructed of one inch schedule 40 PVC piping.

According to the invention, hose 505 is inserted into frame members 501 and 503 and secured in place. It is preferable that hose 505 be constructed of a strong flexible material, such as rubber, and be dimensioned such that its outer diameter is substantially equivalent to the inner diameter of frame members 501 and 503. Hose 505 can be attached to frame members 501 and 503 in any manner, such as by gluing.

Alternatively, hose 505 can continue through the frame members such that it constitutes a closed member. In this case, hose 505 need not be glued to the frame members, as the structural arrangement will keep the frame members and hose in the proper relative position.

Figure 6:
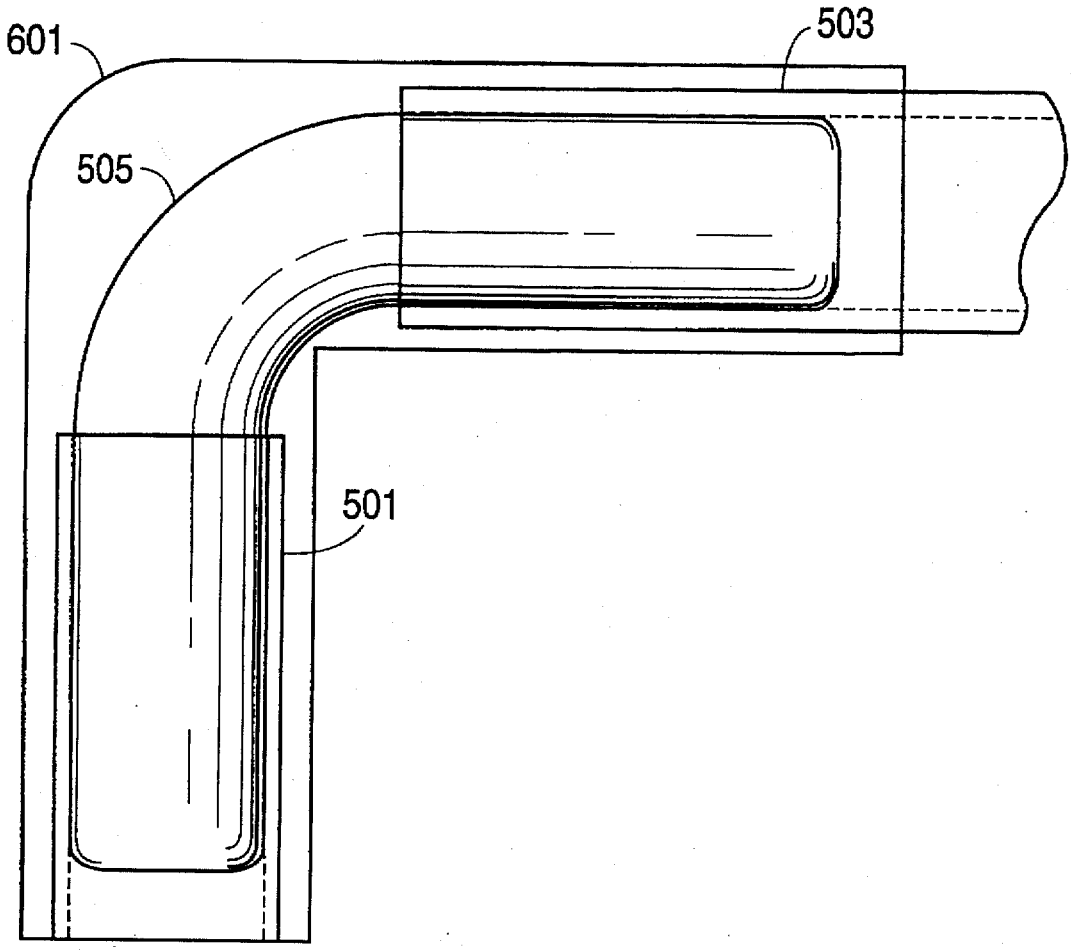
FIG. 6 shows the frame members and hose of FIG. 5 incorporated into an elbow consistent with one embodiment of the invention.

FIG. 6 shows the elements of FIG. 5 along with elbow 601. Elbow 601 is permanently attached to one of the two frame members 501 and 503. Like the frame members, elbow 601 can be constructed of any material. For example, where frame members 501 and 503 are made of PVC piping, elbow 601 can be a PVC joint. Although the frame members and elbow can be constructed of the same material, this is not a requirement of a goal according to the present invention. Thus, it is possible for elbow 601 to be constructed of material which differs from that used for frame members 501 and 503.

In the embodiment shown in FIG. 6, the inner dimension of elbow 601 is the same as the outer dimension of frame members 501 and 503. Thus, the outer dimension of elbow 601 is slightly larger than that of frame members 501 and 503. Alternatively, frame members 501 and 503 can have the same outer dimension as elbow 601 with a gradual or stepped taper such that the end of each frame member fits within elbow 601 and the combination of frame members 501, 503 and elbow 601 provide a smooth outer surface.

The means for permanently attaching elbow 601 to one of the two frame members 501 and 503 can be by any appropriate means, including gluing and/or clamping. Alternatively, elbow 601 and one of the frame members 501 and 503 can be constructed as a single element. For example, if made from PVC, a single piece combining elbow 601 and a frame member, e.g., frame member 503, can be injection molded.

Figure 7:
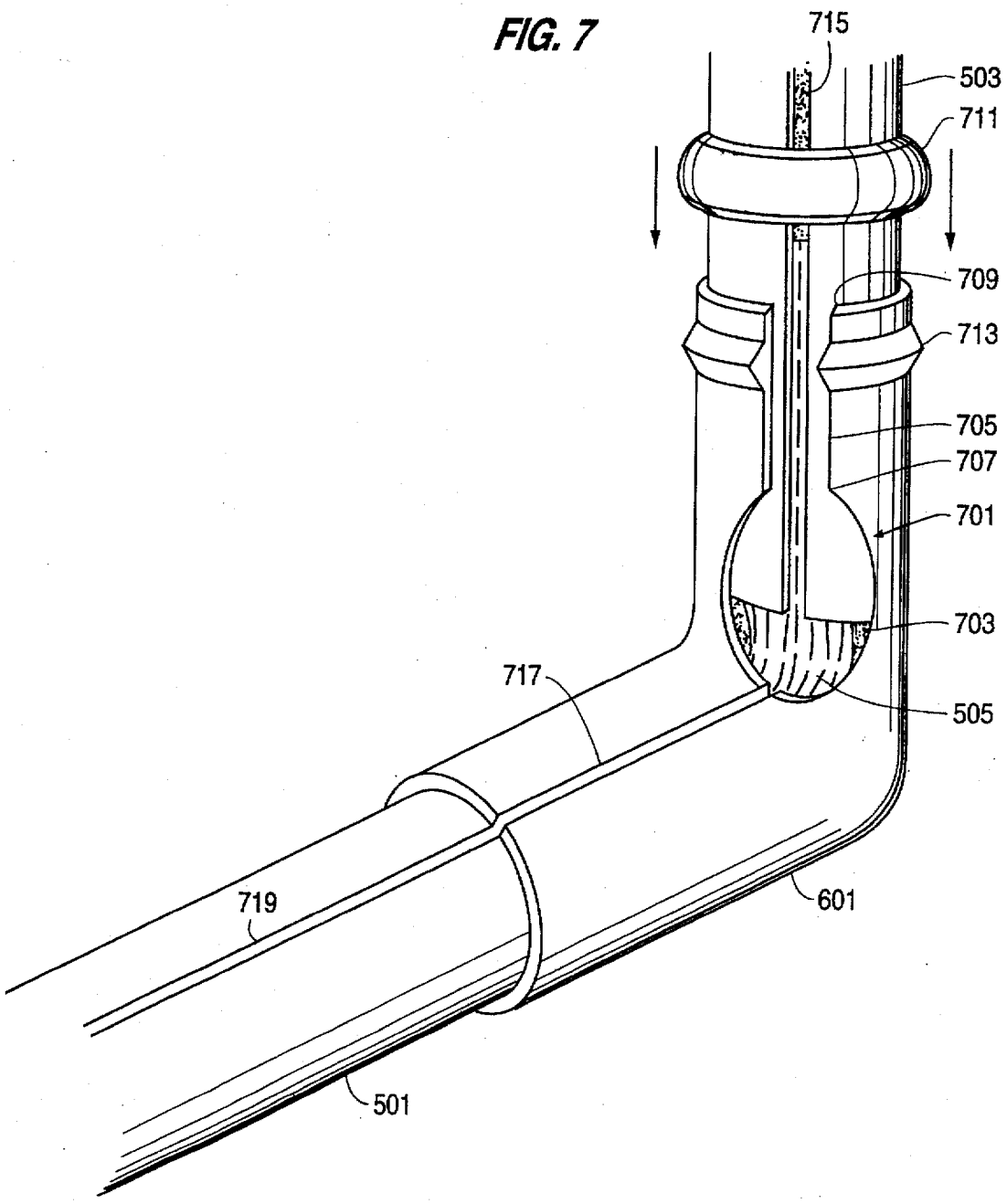
FIG. 7 shows a cap placed around one of the two frame members such that the cap can be engaged with the elbow according to one embodiment of the invention.

As can be seen in FIG. 7, and in accordance with this embodiment of the invention, elbow 601 contains a gap 701. Gap 701 provides freedom of movement of the frame member located in the arm of elbow 601 that contains gap 701. Thus, in the configuration shown in FIG. 7, frame member 501 is permanently attached to elbow 601. Frame member 503 remains attached to frame member 501 via hose 505.

In the collapsed position of the embodiment of FIG. 7, frame member 503 is bent into gap 701, such that frame member 503 is substantially parallel to frame member 501. Here, gap 701 is positioned such that frame member 503 bends directly toward frame member 501. Alternatively, the gap can be positioned such that frame member 503 can bend in any direction, but preferably within ±45° of the position shown in FIG. 7. Regardless of the direction which gap 701 allows frame member 503 to bend, hose 505 allows sufficient flexibility such that, when in the collapsed position, the frame members can rest in a substantially parallel position.

The flexible connection of frame member 503 to frame member 501 via hose 505 allows sufficient freedom of movement such that frame member 503 is not restricted by the portion of elbow 601 opposite the gap as frame member 503 moves into gap 701. In the upright position, frame member 503 is snapped into elbow 601 through gap 701, thereby assuming a substantially fixed position. Thus, it can be seen that if all the joints of a game goal are constructed in this manner, the frame can be easily collapsed for transport and then easily emplaced when use of the goal is desired.

The amount of force necessary to move frame member 503 into and out of gap 701 is a function of the materials used for elements 503 and 601 and is also a function of the size and shape of gap 701. In one example, gap 701 has a substantially circular portion 703 which is approximately 1 inch in diameter such that it matches the outer dimension of frame member 503, and a straight or slightly tapered portion 705 which is, for example, approximately ¾ inch wide between points 707 and 709 in the embodiment disclosed in FIG. 7. An alternate version employs a taper which is ¾ inches wide at point 707 and ½ inch wide at point 709. This configuration, which is constructed of PVC, provides relatively easy movement of frame member 503 into and out of gap 701. This configuration would therefore be suitable for use in a light duty or children's model of a goal according to the present invention. Heavier duty versions can be made of stronger materials, such that there is less "spring" provided by gap 701 or can have a more narrow or more greatly tapered portion 705.

To add to the strength of the joints when the goal is emplaced, a cap 711 can also be employed. As shown in FIG. 7, cap 711 can be slid onto elbow 601 to snap over ridge 713. When collapsing of the joint is desired, cap 711 can then be slid such that it unsnaps from ridge 713. Thus, in the embodiment shown in FIG. 7, cap 711 slides down to engage with elbow 601 and slides up to disengage from elbow 601.

In one example, cap 711 is constructed from a hollowed-out plastic bottle top. However, as should be clear to one skilled in the art, this cap can be made of any material and may or may not match the materials used for frame members 501 and 503 and elbow 601. Also, cap 711 can be built into frame member 503, such that cap 711 slides within a tapered portion of frame member 503, wherein the combination of frame member 503, elbow 601 and cap 711 present a substantially uniform exterior appearance.

In FIG. 7, frame member 503 has groove 715 running along its length. Groove 715 is used in an embodiment of a goal according to the invention in which the hem of the net for the goal is installed inside the frame members. Similar grooves 719 and 717 are contained in frame member 501 and elbow 601. The existence of groove 715, and its dimension, also provide "spring" to frame member 503 which is a factor in determining the amount of force necessary to move frame member 503 into and out of gap 701 of elbow 601.

As shown, groove 717 is centrally located in elbow 601, aligning with groove 719 and groove 715. Alternatively, groove 719 can be positioned such that it contacts any portion of gap 701. Also, grooves 719 and 715 are shown as substantially straight grooves extending the length of their respective frame members. One should understand that these grooves need not be substantially straight, and can therefore rotate, preferably no more than 90° in either direction, around their respective frame members. This will allow a given frame member to have joints at both ends, wherein the joints need not be in exact alignment along the frame member. Of course, the given application to which the joints described herein are applied will likely dictate the optimum placement of the joints, and hence the positioning of the grooves within the frame members.

Figure 8A:
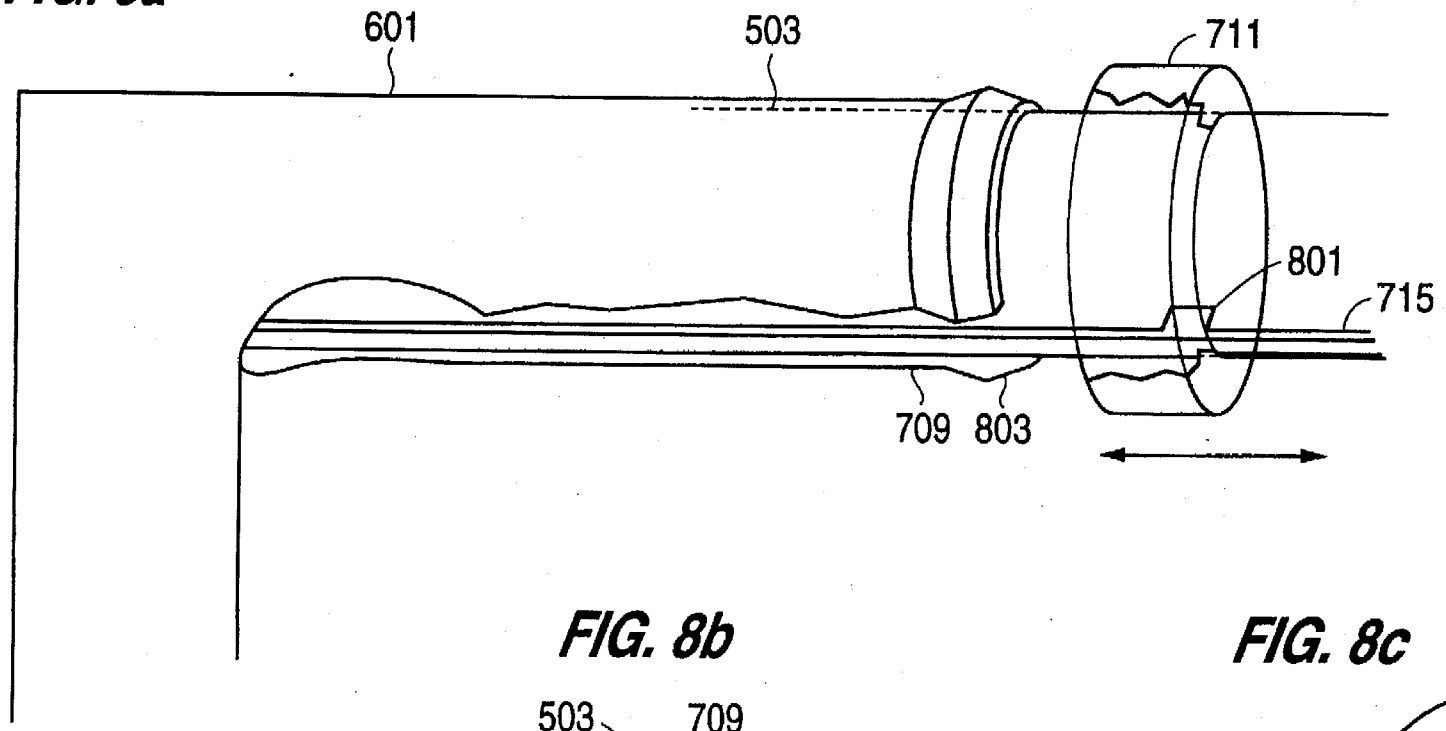
FIG. 8 shows the cap of FIG. 7 further incorporating a tooth which aligns with a notch in the elbow in accordance with one embodiment of the invention.
Figure 8B:
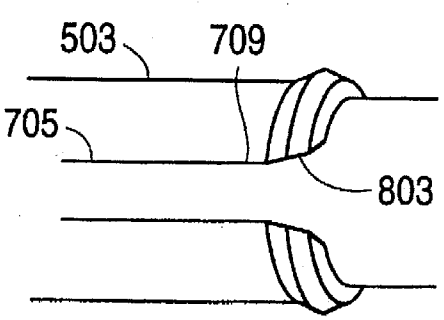
Figure 8C:
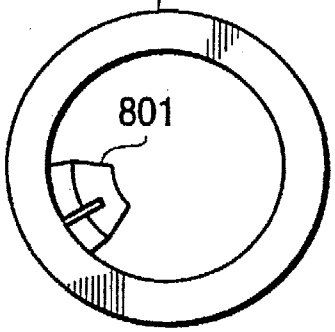

FIG. 8 shows an alternative to the joint shown in FIG. 7. In FIG. 8 cap 711 includes tooth 801 which is dimensioned to fit in notch 803 in elbow 601. This configuration provides for additional strength of the joint when the goal is emplaced.

Figure 9:
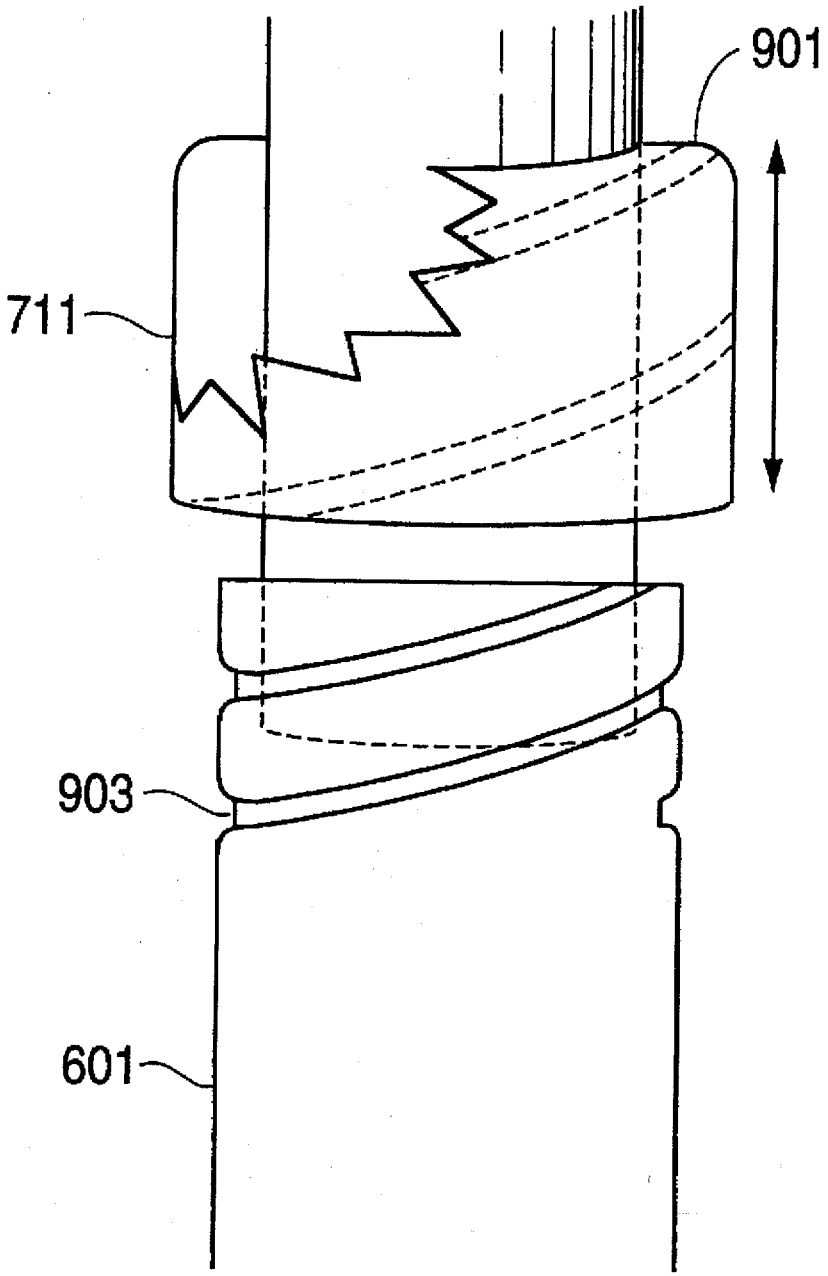
FIG. 9 displays an alternative method according to the invention for engaging the cap with the elbow.

FIG. 9 illustrates an alternative wherein cap 711 has threads 901 which engage corresponding threads 903 of elbow 601 when the cap is engaged with the elbow. Thus, cap 711 can be screwed onto and screwed off of elbow 601. Other methods of attaching cap 711 to elbow 601 are possible in a goal according to the invention. For example, cap 711 can be snapped onto elbow 601 but be configured in a manner wherein it is screwed off of elbow 601.

Figure 10:
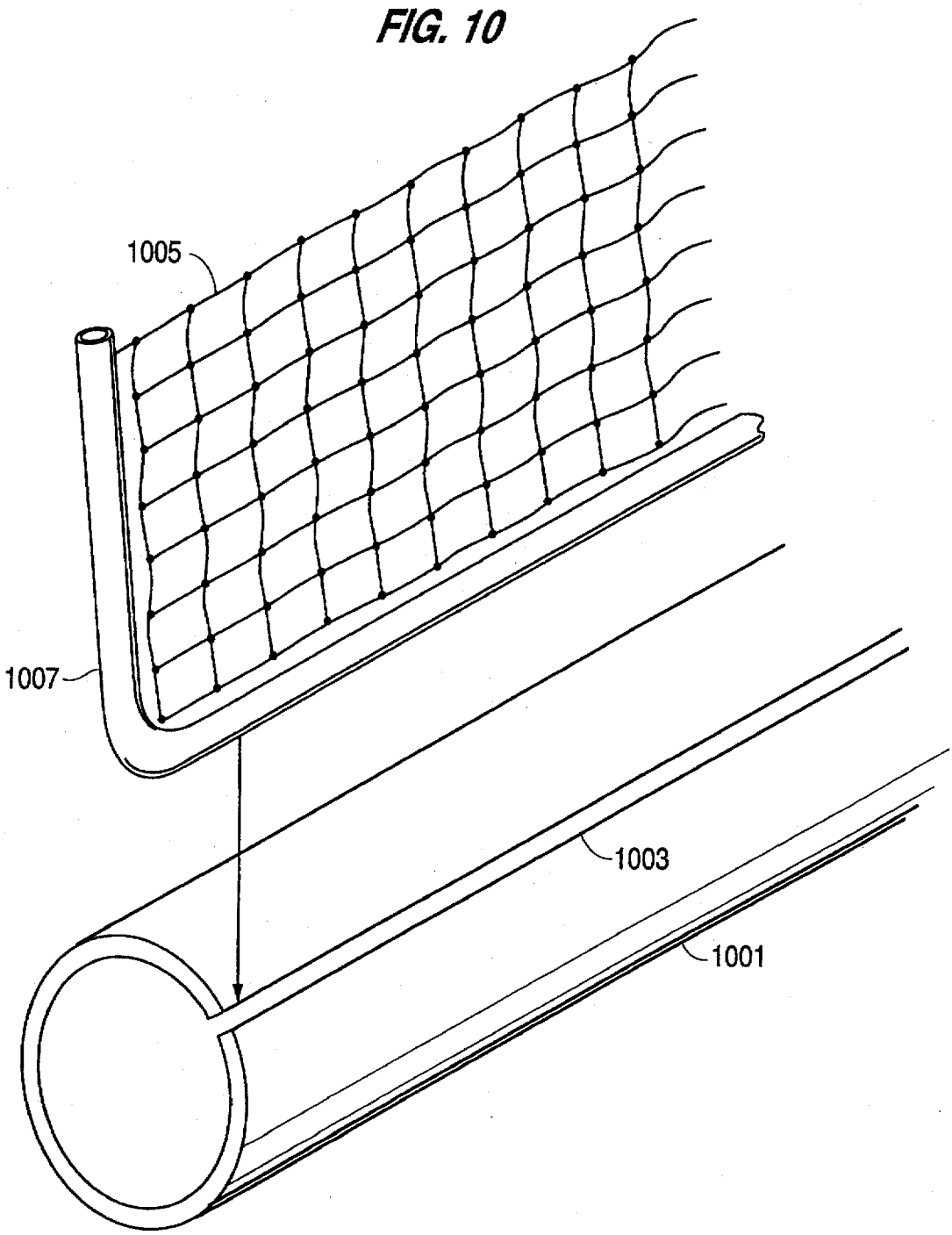
FIG. 10 shows portions of a frame member and a net wherein the hem of the net is placed inside the frame members through a groove in the frame member in accordance with one embodiment of the invention.

FIG. 10 shows a method according to the invention of incorporating the net into the frame. Frame member 1001 has a groove 1003 extending its entire length. Net 1005 has a hem 1007. In the preferred embodiment, groove 1003 is a break in the piping used for frame member 1001. The size of groove 1003 shown in FIG. 10 is for purposes of illustration and not limitation. Depending on the material used for frame member 1001, there will be an amount of spring tension, such that the groove can be expanded to allow for insertion of hem 1007. When the expanding force to overcome the spring tension is removed from groove 1003, the groove will return to its narrow dimension, retaining hem 1007 inside of frame member 1001. In one example previously discussed, groove 1003 is a length-wise cut in schedule 40 PVC pipe used for the frame members. The resulting pipe has sufficient spring tension to allow opening of groove 1003 by hand. The groove 1003 then snaps closed when the opening force is removed. Thus, the hem of the net is retained inside the frame member. The elbows, such as elbow 601, and the caps, such as cap 711, which are used at the joints, provide additional force to keep the grooves, such as groove 1003, in a substantially closed position around the hem, such as hem 1007.

Returning to FIG. 7, it can be seen that the groove 715, 717, 719 is contained in the frame members, such as frame members 501 and 503 and the elbows, such as elbow 601 for use with a goal according to this embodiment of the invention. However, as shown in FIG. 7, cap 711 does not contain such a groove. It would therefore not be possible to install the net into frame member 503 while cap 711 is around frame member 503. Similarly, it would not be possible to put cap 711 around frame member 503 while the net is contained in frame member 503.

One way to provide a cap is to construct a groove in cap 711 similar to groove 715 in frame member 503. However, a groove therein may reduce the strength-providing attributes of cap 711. A preferable alternative is to construct cap 711 in a snap-cap fashion, similar to that used for rings to support shower curtains. The ability of the ends of the cap to snap together would enable cap 711 to be partially opened for placement around frame member 503 through one of the holes of the net. The cap is then snapped closed into a substantially rigid form which provides substantially the same amount of strength when snapped into place as an unbroken cap. The cap can be formed of a resilient material to include a hinge for opening. The cap can be closed by a snap, screw or other convenient means. Alternatively, cap 711 can be sewn into the net such that emplacing the net and putting the cap around frame member 503 can be accomplished at the same time.

Figure 11A:
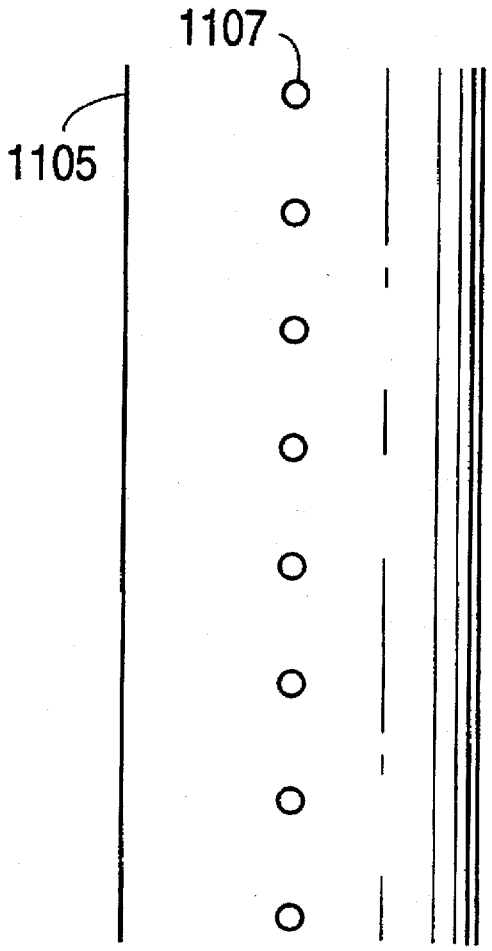
FIGS. 11*a*, 11*b* and 11*c* show alternative embodiments of the invention wherein the net is held in place by a plurality of terminating points which are inserted into a corresponding plurality of holes in the frame members.
Figure 11B:
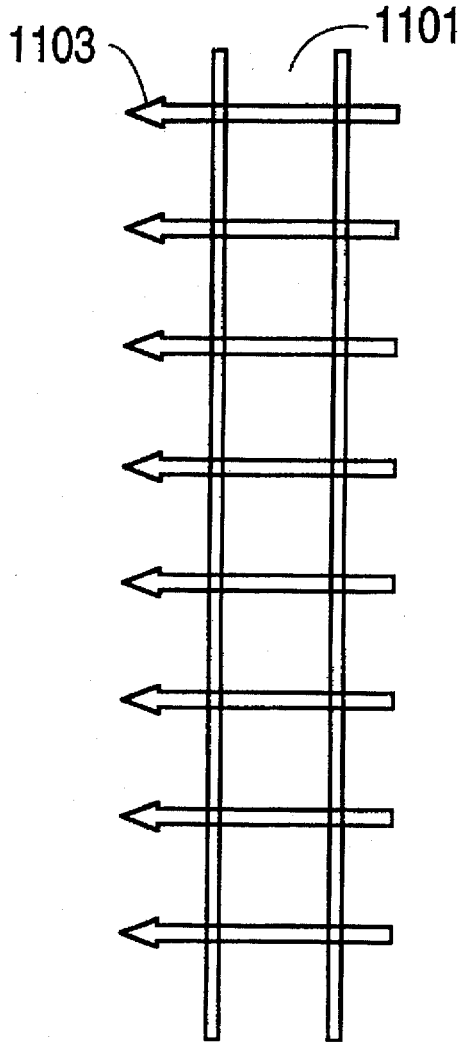

In the alternative embodiment shown in FIGS. 11*a* and 11*b* the net does not have a hem. The edges of net 1101 have a plurality of terminating points 1103. Similarly, frame member 1105 contains a plurality of holes 1107 corresponding to terminating points 103. The terminating points are, e.g., resilient plastic arrowheads with tips and flared ends. The flared ends deform when pushed through the holes and when completely through assume their flared shape retaining the arrowhead and the net on the frame. The net 1101 is snapped into frame 1105 by inserting terminating points 1103 into their corresponding holes 1107. This configuration has the advantage of maintaining the structural integrity of the frame members but has a disadvantage of complicating the replacement of the net. Here, once net 1101 is installed into frame member 1105, the only way to remove net 1101 is to cut the net near frame 1105. This will cause terminating points 1103 to fall through hollow frame member 1105 and allow for the installation of another net by placing its terminating points 1103 into holes 1107. An advantage of this configuration is that it allows for the replacement of the net without the aforementioned concerns about cap 711. In addition, individual terminating points may be replaced, as needed.

Figure 11C:
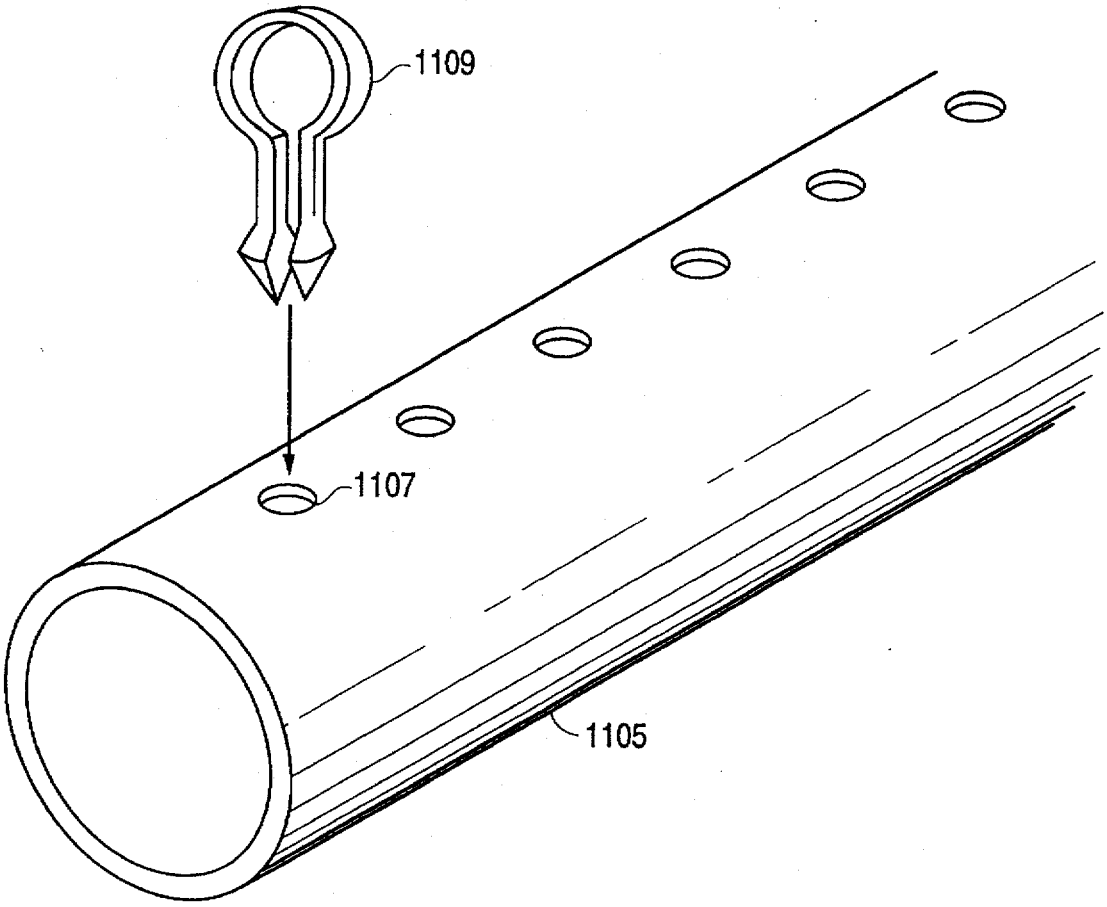

FIG. 11*c* shows another alternative similar to that of FIGS. 11*a* and 11*b*. Here, instead of flared terminating points being built into the net, as in FIG. 11*b*, U-shaped terminating points 1109 can be placed around a portion, for example, the hem, of a net and then snapped into holes 1107. This embodiment allows the advantages of the embodiment of FIGS. 11*a* and 11*b* without the disadvantage of constructing special nets. In addition, terminating points 1109 can be constructed of a resilient material such that they can be compressed for easy removal from the frame to facilitate replacement of the net.

Figure 12:
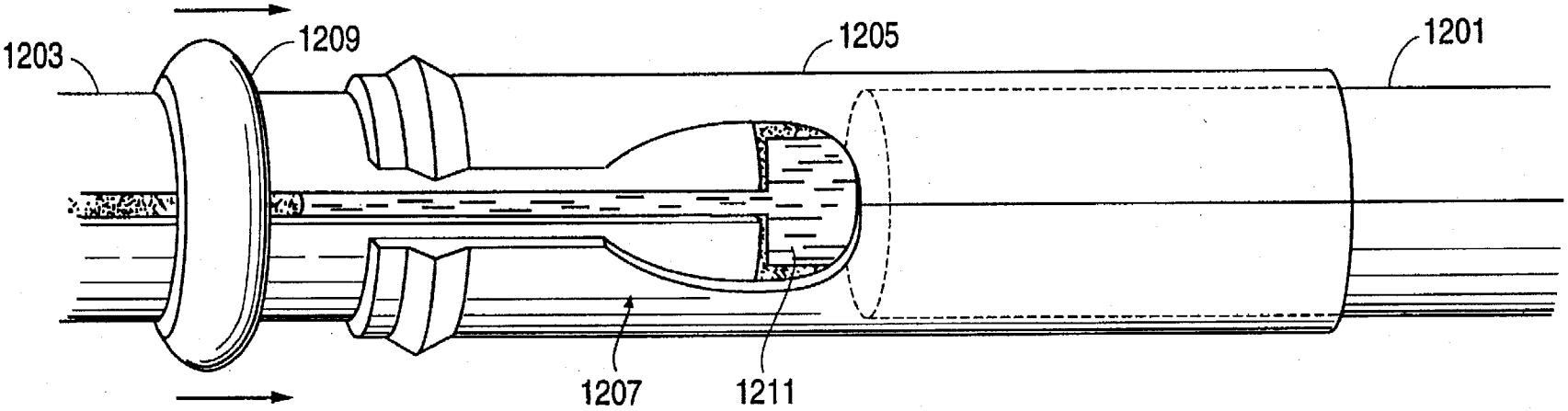
FIG. 12 displays an alternative embodiment of the invention incorporating a joint along a straight member, such as the crossbar.

FIG. 12 shows an alternative embodiment of the invention wherein a joint is incorporated into a substantially straight member, such as the crossbar of the goal. Frame members 1201 and 1203 are connected by arm 1205. As described above for orthogonally positioned frame members 501 and 503, frame members 1201 and 1203 are also connected by a flexible material such as rubber hose 1211. Arm 1205, in the embodiment shown, is permanently connected to frame member 1201 and has gap 1207 which allows frame member 1203 to bend from the position shown in FIG. 12 toward a position substantially parallel to frame member 1201. The dimensions of the frame members and the flexibility of hose 1211 determine the amount of displacement toward a parallel position actually achieved. Cap 1209 is alternatively provided to engage with arm 1205 if additional strength is needed. The configuration shown in FIG. 12, shows grooves in frame members 1201 and 1203 and arm 1205 to accommodate the hem of a net. It should be clear to one skilled in the art that this configuration applies to only one of the alternative embodiments of the present invention. Alternatively, for example, frame members 1201 and 1203 and arm 1205 could contain a plurality of holes to align with terminating points of the net.

FIG. 13 displays two alternative configurations of a joint at the point (point joint) of a lacrosse goal, in accordance with one embodiment of the invention. The point joint is at the intersection of the two lower frame members in the back of the goal. Such a joint is only used with goals which have lower frame members, such as the goal shown in FIG. 1, and not for goals shown in FIGS. 3 and 4.

As can be seen from FIG. 1, the frame members meeting at the point joint both lie flat on the surface upon which the game is being played. Since there is significantly less need for structural rigidity at the point joints than there is for the other joints of the frame, the two lower frame members can be connected via any flexible means which keeps them connected but allows for relative freedom of movement. In the two examples of FIGS. 13*a* and 13*b*, lower frame members 1301 and 1303 are connected by rubber hoses in two configurations. In FIG. 13*a*, rubber hose 1305 is dimensioned such that its interior dimension matches the exterior dimension of frame members 1301 and 1303. In the configuration shown in FIG. 13*b*, rubber hose 1307 is dimensioned such that its outer dimension matches the inner dimension of frame members 1301 and 1303. In either embodiment, the hose is connected with the frame members in any conventional manner, including the use of adhesives, clamps and the like. Alternatively, in an embodiment wherein a single rubber hose runs through the entire length of all of the frame members, there is no need to glue the rubber hose to the joints and the rubber hose will serve as an inside point such as shown in FIG. 13*b*.

Figure 14:
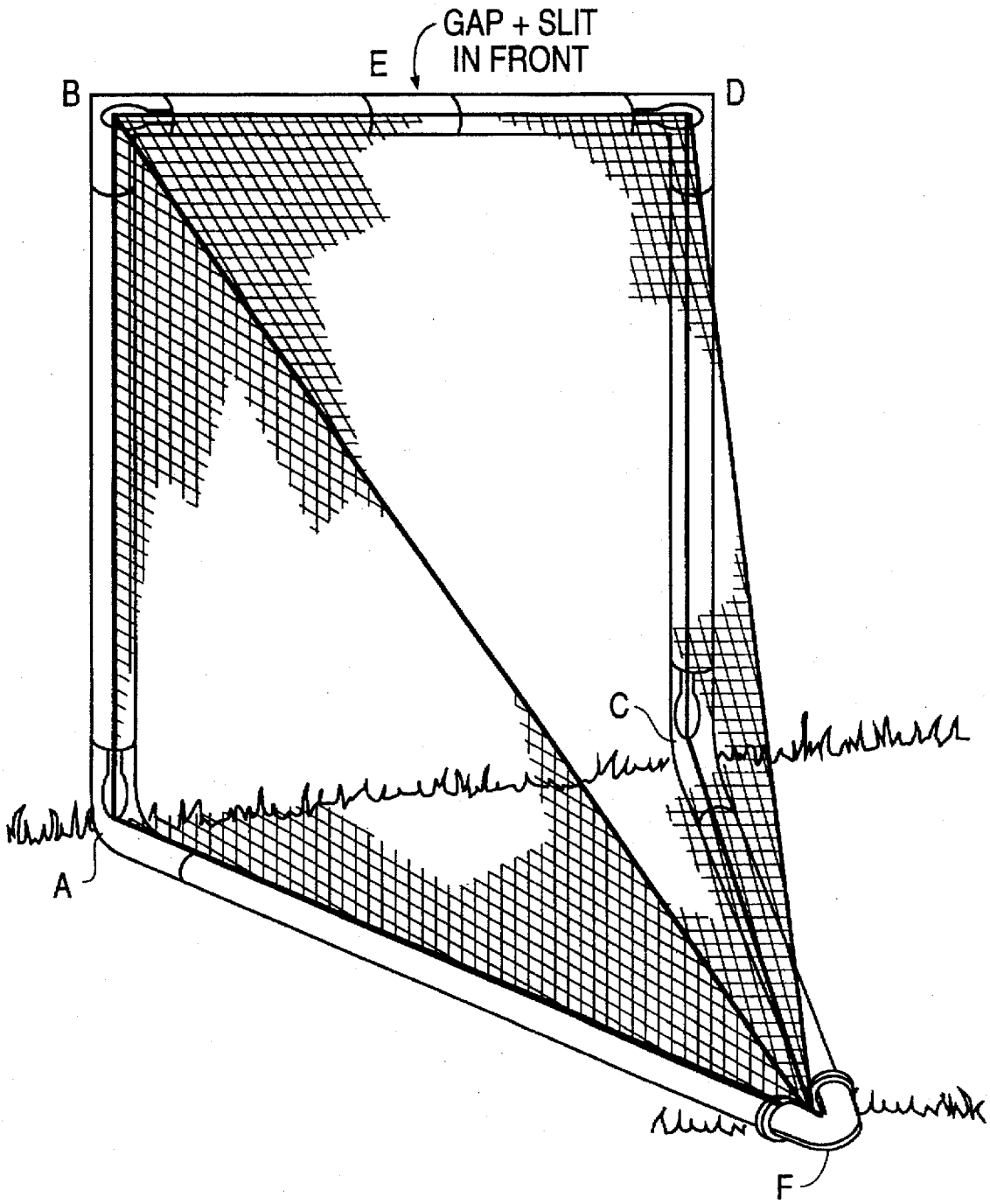
FIG. 14 shows the locations of the aforementioned joints in a preferred embodiment of the invention for a lacrosse goal.

Game goals, such as lacrosse goals, which require a substantially rigid frame for use in a game, can be configured according to the invention such that the goals are easily collapsible, and therefore easily transportable. In a preferred embodiment of the invention, joints such as that described in FIG. 7 exist at each of the two intersection points for each of the two uprights. Also, a joint such as that described in FIG. 12 is placed substantially in the center of the crossbar. The location, and configuration of these joints in the preferred embodiment are described in FIG. 14. FIG. 14 shows a goal having the same shape as the conventional lacrosse goal in FIG. 1 but also includes preferred locations for the joints described herein to construct a lacrosse goal according to the invention.

Figure 13B:
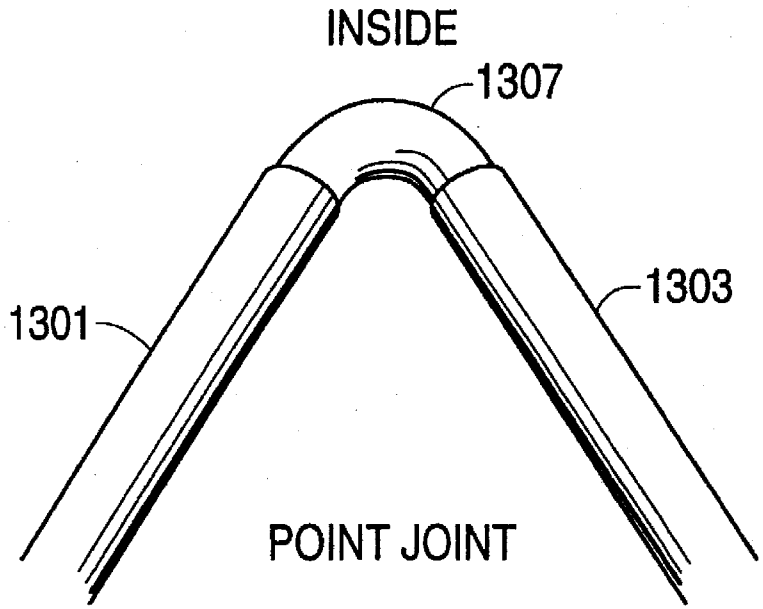
FIGS. 13*a* and 13*b* show alternative methods of constructing a point joint in one embodiment of the invention.
Figure 13A:
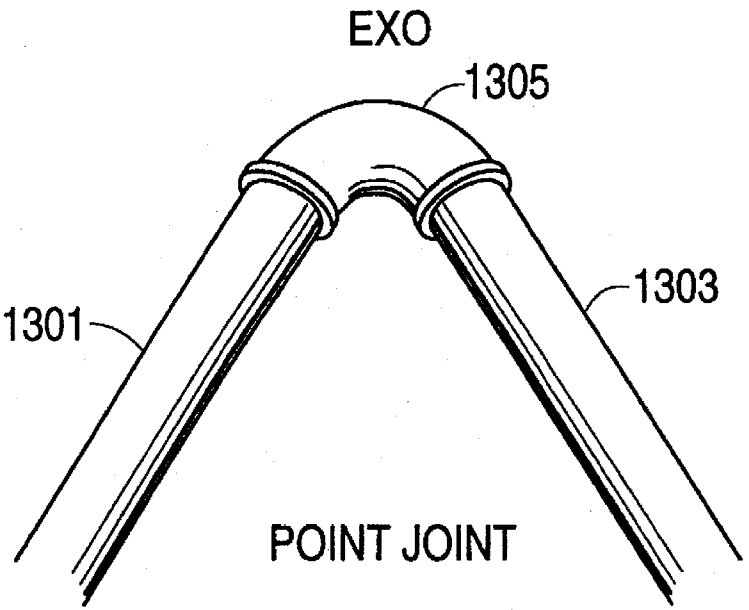

As described above, point joint F is the intersection of the two lower frame members and can preferably be configured either as shown in FIG. 13*a* or as shown in FIG. 13*b*.

Joints A and C, which are the intersections of the lower frame members and the uprights, are preferably configured as shown in FIG. 7 with the fixed portion (that corresponding to frame member 501) constituting the lower frame member and the moveable portion (corresponding to frame member 503) constituting the uprights. When being collapsed, the uprights bend toward point joint F as can be seen by the fact that the gaps in the elbows of these joints face point joint F.

Joints B and D are the intersections of the uprights with the crossbar. Here, in the preferred embodiment, the uprights are the fixed members (corresponding to frame member 501 of FIG. 2) and the crossbar is the moveable member (corresponding to frame member 503). Thus, when collapsing, in the preferred embodiment, the crossbar bends such that its center points back toward point joint F. As is clear from his description, in this embodiment of a goal according to the invention the crossbar also has a joint which is part of the crossbar, allowing the crossbar to bend.

This crossbar joint is shown, preferably central to the crossbar, as point E of FIG. 14. This is a joint such as that shown in FIG. 12 wherein either side of the crossbar can be the fixed member with the other side serving at the moveable member. The crossbar will then, when collapsing, bend toward point joint F.

It is therefore preferred, in the embodiment described above, that when collapsing the goal, joint E be broken first. This then allows joints B and D to break such that the crossbar elements swing back toward point joint F. As has been mentioned earlier, point joint F is substantially flexible. Thus, when joints B, C, and D are broken, the uprights can be brought together into a substantially parallel position. At this point, joints A and C can be broken to allow the uprights and crossbar to swing back toward joint F, substantially parallel to the lower frame members.

Figure 15:
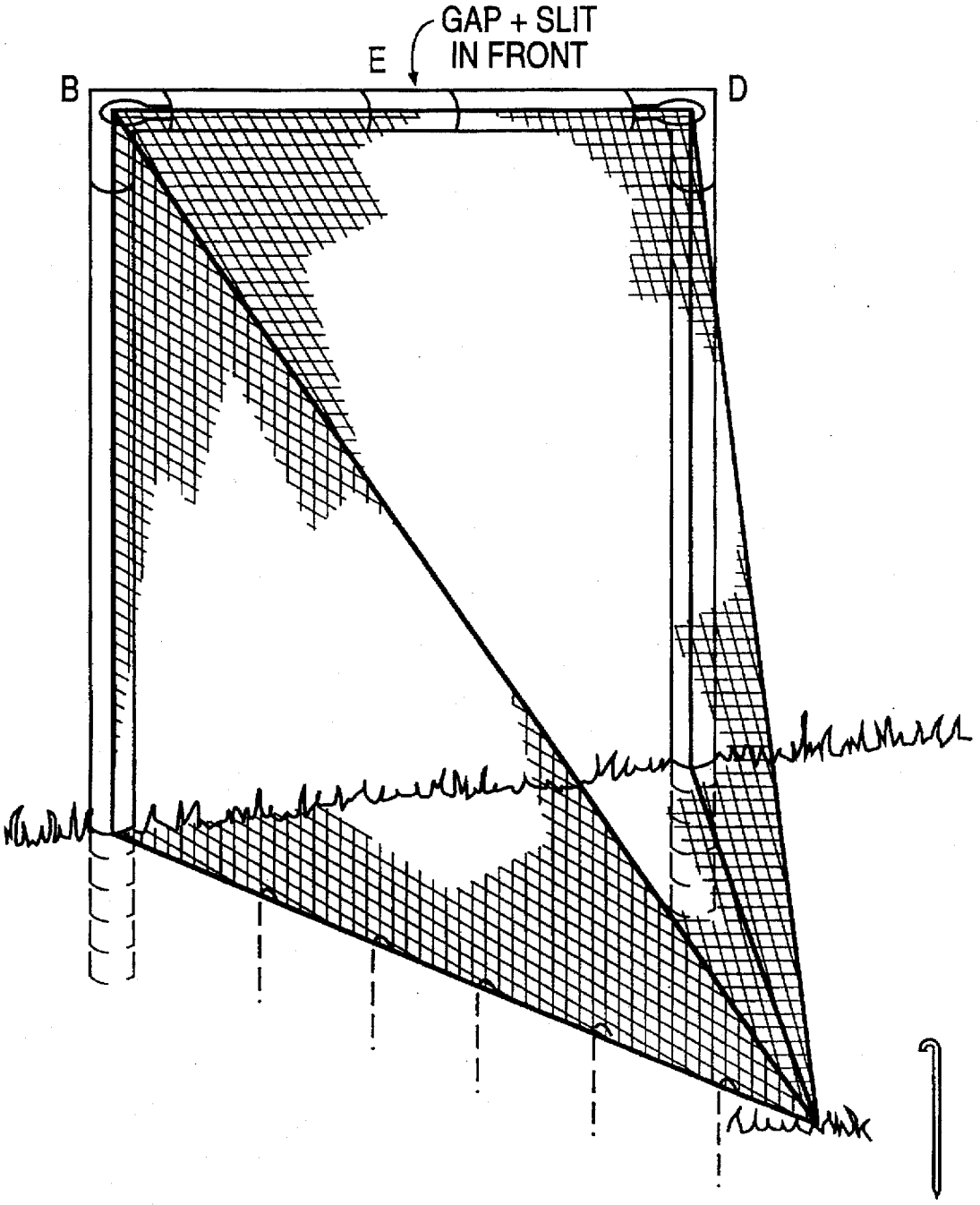
FIG. 15 shows the locations of the joints in an alternative embodiment of the invention for a Lacrosse goal.

FIG. 15 shows the turf embodiment of the invention, containing only joints B, C and D. Here, to collapse the goal, one would remove the spikes holding the net to the ground, remove the uprights from their support spikes and then break joints B, C, and D. In this embodiment, since there are no lower frame members, joints B and D can be configured to break in any direction. As shown in FIG. 15, they will break such that the point in the crossbar faces toward the rear of the goal. Alternatively, they can be configured, for example, such that the point in the crossbar faces downward.

According to the invention, a full size lacrosse goal can be collapsed in a very short amount of time into a substantially small package which is easily transported. Further, the same lacrosse goal can be easily emplaced in a minimum amount of time. To put the lacrosse goal in place, it is recommended that the steps described above merely be carried out in reverse order.

While several embodiments of the invention have been described, it will be understood that it is capable of further modifications. For example, the goals described herein use a net as the means for receiving a projectile. It should be understood that a net is used to allow spectators an unobscured view of the game. Alternatively a solid cloth could be used in place of the net. Such a cloth could be clear, opaque or any combination thereof. Similarly, a projectile receiving means could be made of portions of a solid cloth or any other composition approximating the functionality of a net. Thus, this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A collapsible game goal comprising:

a crossbar;

at least two uprights;

a first joint at a first intersection between a first of the uprights and the crossbar;

a second joint at a second intersection between a second of the uprights and the crossbar;

a net;

a plurality of U-shaped terminating points each positioned around a portion of the net, wherein the uprights and the crossbar have a plurality of holes for receiving the U-shaped terminating points;

at least two lower frame members, said at least two lower frame members having holes for receiving said u-shaped terminating points;

a third joint at a third intersection of one of the at least two lower frame members and the first of the uprights:

a fourth joint at a fourth intersection of another of the at least two lower frame members and the second of the uprights, each of the third and fourth joints having an elbow and a flexible link, each flexible link connecting one of the uprights to one of the lower frame members, and each elbow having a gapped arm and an ungapped arm.

2. The collapsible game goal of claim 1, further comprising a point joint at a fifth intersection of the one lower frame member and the other lower frame member.

3. The collapsible game goal of claim 1, wherein the flexible link is a rubber hose.

4. A collapsible game goal comprising:

a crossbar;

at least two uprights;

a first joint at a first intersection between a first of the uprights and the crossbar; and a second joint at a second intersection between a second of the uprights and the crossbar;

wherein the first joint includes a first elbow comprising a first gapped arm and a first ungapped arm, the first gapped arm being fixed at approximately 90 degrees relative to the first ungapped arm, the first ungapped arm being connected to one of the first upright and the crossbar, and the other of the first upright and the crossbar being in one of a fixed position and a collapsed position, said goal being in said fixed position when an end of the other of the first upright and the crossbar is positioned inside the first gapped arm and the collapsed position when the end is positioned outside the first gapped arm.

5. The collapsible game goal of claim 4, wherein the second joint includes a second elbow comprising a second gapped arm and a second ungapped arm, the second gapped arm being fixed at approximately 90 degrees relative to the second ungapped arm, the second ungapped arm being connected to one of the second upright and the crossbar, and the other of the second upright and the crossbar being in one of the fixed position and the collapsed position, such that when the goal is in the fixed position, an end of the other of the second upright and the crossbar is positioned inside the second gapped arm and when the goal is in the collapsed position to end is positioned outside the second gapped arm.

6. The collapsible game goal of claim 4, wherein the first joint further comprises a flexible link connecting the first upright to the crossbar.

7. The collapsible game goal of claim 6, wherein the first joint further comprises a cap, the cap being positioned around the other of the first upright and the crossbar, the cap being in one of an engaged position and an unengaged position, the engaged position corresponding to the cap being in contact with the gapped arm and the unengaged position corresponding to the cap not being in contact with the gapped arm.

8. The collapsible game goal of claim 7, wherein the cap further comprises a tooth and the gapped arm further comprises a notch, the tooth fitting into the notch when the cap is in the engaged position.

9. A collapsible game goal comprising:

a net;

a crossbar, containing at least one joint;

at least two uprights;

at least two lower frame members;

a first joint at a first intersection between a first of the uprights and the crossbar, the first joint including a first elbow comprising a first gapped arm and a first ungapped arm, the first gapped arm being fixed at approximately 90 degrees relative to the first ungapped arm, the first ungapped arm being connected to one of the first upright and the crossbar, and the other of the first upright and the crossbar being in one of a fixed position and a collapsed position, when an end of the upright and the crossbar is positioned inside the first gapped arm and the collapsed position when the end is positioned outside the first gapped arm, the first joint further comprising a flexible link connecting the first upright to the crossbar, the first joint further comprising a cap, the cap being positioned around the other of the first upright and the crossbar, the cap being in one of an engaged position and an unengaged position, the engaged position corresponding to the cap being in contact with the gapped arm and the unengaged position corresponding to the cap not being in contact with the gapped arm, the first joint further comprising a clamp connecting the first ungapped arm to the one of the first upright and the crossbar;

a second joint at a second intersection between a second of the upright and the crossbar, the second joint including a second elbow comprising a second gapped arm and a second ungapped arm, the second gapped arm being fixed at approximately 90 degrees relative to the second ungapped arm, the second ungapped arm being connected to one of the second upright and the crossbar, and the other of the second upright and the crossbar being in one of the fixed position and the collapsed position, such that when the goal is in the fixed position an end of the other of the second upright and the crossbar is positioned inside the second gapped arm and when the goal is in the collapsed position the end is positioned outside the second gapped arm, the second joint further comprising a flexible link connecting the second upright to the crossbar, the second joint further comprising a cap, the cap being positioned around the other of the second upright and the crossbar, the cap being in one of an engaged position and an unengaged position, the engaged position corresponding to the cap being in contact with the gapped arm and the unengaged position corresponding to the cap not being in contact with the gapped arm, the second joint further comprising a clamp connecting the second ungapped arm to the one of the second upright and the crossbar;

a third joint at a third intersection of one of the at least two lower frame members and the first upright, the third joint including a third elbow comprising a third gapped arm and a third ungapped arm, the third gapped arm being, fixed at approximately 90 degrees relative to the third ungapped arm, the third ungapped arm being connected to one of the first upright and the one of the lower frame members, and the other of the first upright and the one of the lower frame members being in one of a fixed position and a collapsed position, such that when the goal is in the fixed position an end of the other of the first upright and the one of the lower frame members is positioned inside the third gapped arm and when the goal is in the collapsed position the end is positioned substantially outside the third gapped arm, the third joint further comprising a flexible link connecting the first upright to the one of the lower frame members, the third joint further comprising a cap, the cap being positioned around the other of the first upright and the one of the lower frame members, the cap being in one of an engaged position and an unengaged position, the engaged position corresponding to the cap being in contact with the gapped arm and the unengaged position corresponding to the cap not being in contact with the gapped arm, the third joint further comprising a clamp connecting the third ungapped arm to the one of the first upright and the one of the lower frame members;

a fourth joint at a fourth intersection of another of the at least two lower frame members and the second upright, the fourth joint including a fourth elbow comprising a fourth gapped arm and a fourth ungapped arm, the fourth gapped arm being fixed at approximately 90 degrees relative to the fourth ungapped arm, the fourth ungapped arm being connected to one of the second upright and the other of the lower frame members, and the other of the second upright and the other of the lower frame members is in one of a fixed position and a collapsed position, such that when the goal is in the fixed position an end of the other of the second upright and the other of the lower frame members is positioned inside the third gapped arm and when the goal is in the collapsed position the end is positioned outside the third gapped arm, the third joint further comprising a flexible link connecting the second upright to the other of the lower frame members, the third joint further comprising a cap, the cap being positioned around the other of the second upright and the other of the lower frame members, the cap being in one of an engaged position and an unengaged position, the engaged position corresponding to the cap being in contact with the gapped arm and the unengaged position corresponding to the cap not being in contact with the gapped arm, the third joint further comprising a clamp connecting the third ungapped arm to the one of the second upright and the other of the lower frame members;

a point joint at a fifth intersection of the one lower frame member and the other lower frame member; and a plurality of U-shaped terminating points engaged with the net, wherein the uprights, the crossbar and the lower frame members include net receiving means, the net receiving means comprising a corresponding plurality of holes, the holes receiving the U-shaped terminating points.

10. A method of connecting two frame members of a collapsible game goal, the method comprising the steps connecting a first frame member to an ungapped arm of an elbow;

connecting a first end of a hose to the first frame member;

connecting a second end of the hose to a second frame member;

placing the second frame member inside a gapped arm of the elbow; and engaging a cap with the gapped arm of the elbow.

11. A method of collapsing a game goal, the method comprising the steps of:

disengaging a cap from a gapped arm of an elbow of at least one joint; and pushing a frame member through a gap in the gapped arm and reengaging said cap on said gapped arm.

12. A joint at an intersection between a first frame member and a second frame member including an elbow comprising a gapped arm and an ungapped arm, the gapped arm being fixed at approximately 90 degrees relative to the ungapped arm, the ungapped arm being connected to the first frame member, and the second frame member being in one of a fixed position and a collapsed position, said frame being in said fixed position when an end of said second frame member is positioned inside said gapped arm and the collapsed position when the end is positioned outside the gapped arm.

* * * * *